United States Patent [19]

Brown, Jr.

[11] 4,295,609

[45] Oct. 20, 1981

[54] WALL MOUNTED DRINKING FOUNTAIN WITH PUSH BAR ACTUATOR

[75] Inventor: Frank Brown, Jr., Wilmington, Del.

[73] Assignee: Sunroc Corporation, Glen Riddle, Pa.

[21] Appl. No.: 958,146

[22] Filed: Nov. 6, 1978

[51] Int. Cl.[3] ..... E03B 9/20

[52] U.S. Cl. ..... 239/29; 4/191; 4/619; D15/118

[58] Field of Search ..... 239/24–30, 239/282; D15/118; 4/166, 167, 187 R, 619, 620, 623, 191, 192

[56] References Cited

U.S. PATENT DOCUMENTS

| | | | |
|---|---|---|---|
| D. 237,546 | 11/1975 | Kelly | D15/118 |
| 2,673,352 | 3/1954 | Knowles | 4/166 |
| 2,739,461 | 3/1956 | Canter | 239/29.5 |
| 2,819,926 | 1/1958 | Wood | 239/29 |
| 2,888,812 | 6/1959 | Wood | 239/29 |
| 3,567,121 | 3/1971 | Dreibelbis | 239/29.5 |
| 3,799,439 | 3/1974 | Wright | 239/29 |

OTHER PUBLICATIONS

"Oasis Soft Touch Cooler" from *Architectural Record*, Jan. 1977, p. 64.

"Haws Water Coolers/Drinking Fountains/Emergency Equipment" Catalog No. 178, Aug. 1977, pp. 3 & 4, Model HWC-8.

*Primary Examiner*—Robert B. Reeves
*Assistant Examiner*—Michael J. Forman
*Attorney, Agent, or Firm*—Harvey B. Jacobson

[57] ABSTRACT

A drinking fountain of the wall hung type having a push bar actuator operable and usable by a handicapped occupant of a wheel chair without assistance by others. A cabinet is adapted to be mounted on a wall, and a control valve is actuated by an inwardly depressible push bar in the front wall thereof which is supported by pivot means and the push bar operates a control valve to cause a stream of drinking water to be dispensed in an upward trajectory from a drinking spout mounted upon the cabinet. The push bar is capable of being actuated by gently pushing either end or the middle of the bar inwardly with a return spring providing automatic shut-off when the push bar is released.

2 Claims, 3 Drawing Figures

WALL MOUNTED DRINKING FOUNTAIN WITH PUSH BAR ACTUATOR

BACKGROUND OF THE INVENTION

1. Field of the Invention

The invention relates to a drinking fountain of the wall hung type adapted for use by a wheel chair occupant, more particularly, to a wall hung drinking fountain activated by a front mounted push bar operable by a wheel chair occupant for controlling the dispensing of drinking water from a spout attached to the top of the cabinet of the drinking fountain.

2. Description of the Prior Art

Wall hung water coolers and drinking fountains are known in the prior art. For example, a wall hung drinking fountain is disclosed in U.S. Pat. No. 3,091,100, issued May 28, 1963, to E. Sorensen et al. The wall hung water cooler of Sorensen, et al, has a drinking fountain nozzle operated by a push button to control the supply of water. Such a configuration of push button and nozzle, while satisfactory for use by a person standing or bending over the device, has been found less than completely satisfactory for use by the occupant of a wheel chair who is physically handicapped, due in part to the inconvenient height of the push button with respect to the arms of the wheel chair and the person lacking the necessary manual dexterity and strength required to manipulate the push button. Other patents suggesting the state of the prior art include the following:

U.S. Pat. No. 2,739,461—Mar. 27, 1956—Canter

U.S. Pat. No. 3,540,654—Nov. 17, 1970—Murdock et al

U.S. Pat. No. 3,630,445—Dec. 28, 1971—Wright

U.S. Pat. No. 3,734,408—May 22, 1973—Wright

U.S. Pat. No. De. 190,147—Apr. 18, 1961—Fink

U.S. Pat. No. De. 223,781—June 6, 1972—Wright.

While the two Wright utility patents show a valve actuator in the peripheral wall of the drinking fountain, such devices fail to provide for operation by handicapped occupants of a wheel chair.

SUMMARY OF THE INVENTION

The present invention attempts to overcome problems encountered by wheel chair occupants in using drinking fountains of prior art construction by providing a push bar mounted in the front wall of the drinking fountain near the level of the arms of a wheel chair.

It is accordingly an object of the present invention to provide a drinking fountain for use by a wheel chair occupant without assistance by another person.

It is another object of the present invention to comply with legislation enacted to require facilities for use by physically handicapped persons. Public Law 90-480 requires, for example, that buildings constructed, leased, or financed by the U.S. Government be so equipped that handicapped person can visit, work in or carry out business in such buildings.

Still another object of the present invention is to provide a drinking fountain operated by a soft touch, self-closing vandal-resistant push bar operable from either end or the middle of the bar.

Yet another object of the invention is to provide an aesthetically designed, extremely functional drinking fountain for use in facilities frequented by the physically handicapped, particularly, for example, hospitals, public buildings, schools, and other similar facilities.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
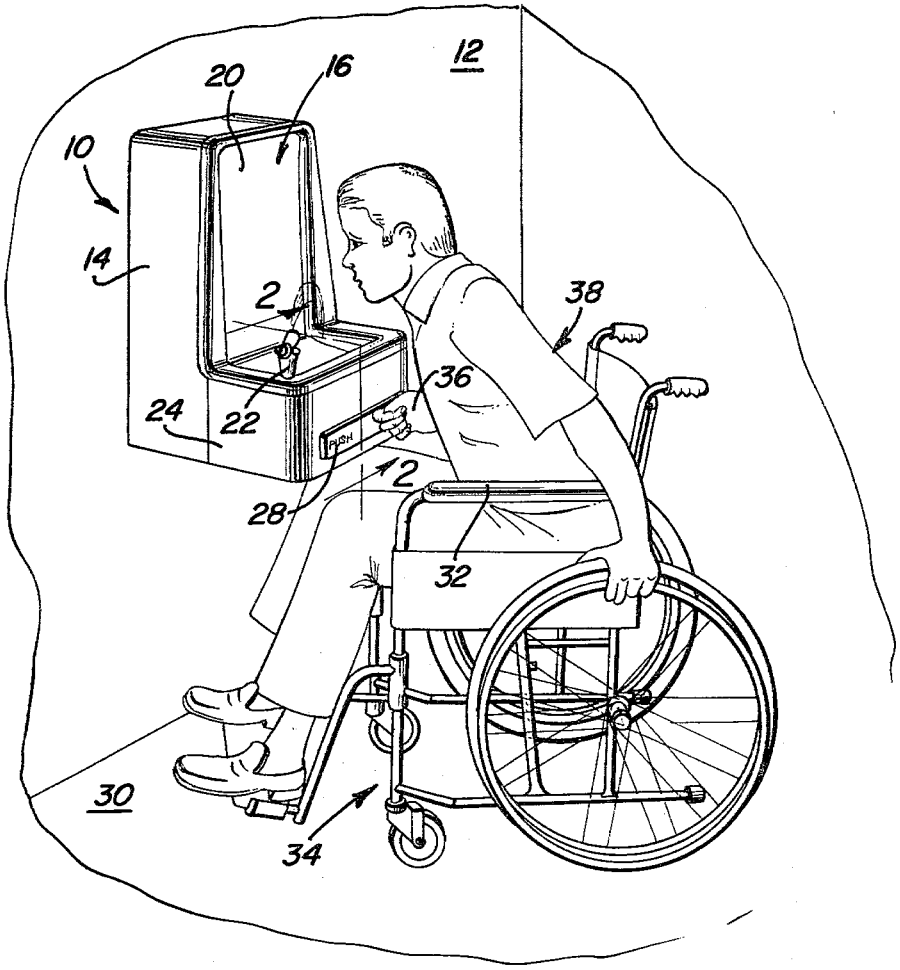
FIG. 1 is a perspective view showing the drinking fountain of the present invention as it is placed in operation by the occupant of a wheel chair.

In FIG. 1, the drinking fountain incorporating the present invention therein is designated generally by the numeral 10, and is hung by conventional mounting means (not shown) on wall 12. Such mounting means, well-known to those skilled in the art, can include a mounting bracket assembly for attachment on wall 12 by conventional means, and upon which cabinet or wrapper assembly 14 is attached. Basin assembly 16 comprises drain pan 18 and splash shield 20 rising a substantial height above drain pan 18. Waste water from drinking fountain 10 is removed by a drain conduit (not shown) beneath drain pan 18, communicating with building plumbing behind or within wall 12. Attached to basin assembly 16 in a conventional manner in a bubbler or drinking spout 22 having the usual push button control member. Apron assembly 24 forms the front and sides of drinking fountain 10 beneath drain pan 18 with the bottom of the apron assembly being spaced above the floor sufficient to enable a wheel chair and occupant to approach the drinking fountain. The foregoing is well-known structure in this art.

In this invention, apron assembly 24 has a rectangular slot 26 through which projects push bar 28. It is readily apparent from FIG. 1 that push bar 28 is located horizontally at a height above floor 30 approximating the level of arms 32 of the wheel chair 34 and adjacent the normal position of the hands 36 of the wheel chair occupant 38, while drinking spout 22 is located at a height above floor 30 convenient for drinking by the seated occupant 38 of the wheel chair 34. Accordingly, no assistance is required for the wheel chair occupant to operate and use drinking fountain 10.

Figure 2:
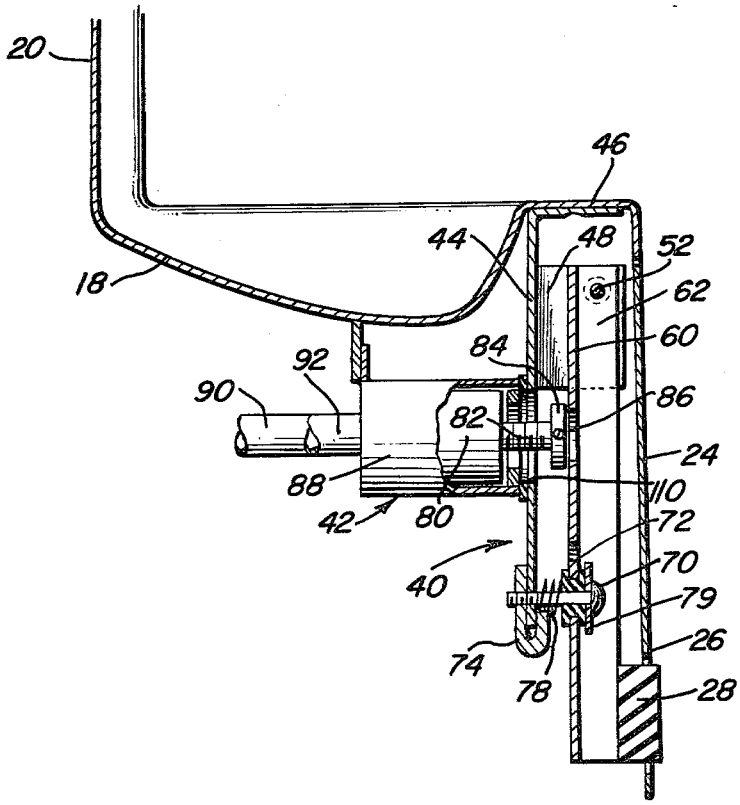
FIG. 2 is a sectional view taken substantially upon a plane passing along section line 2—2 on FIG. 1 showing details of the arrangement of parts for actuating the water flow control valve.
Figure 3:
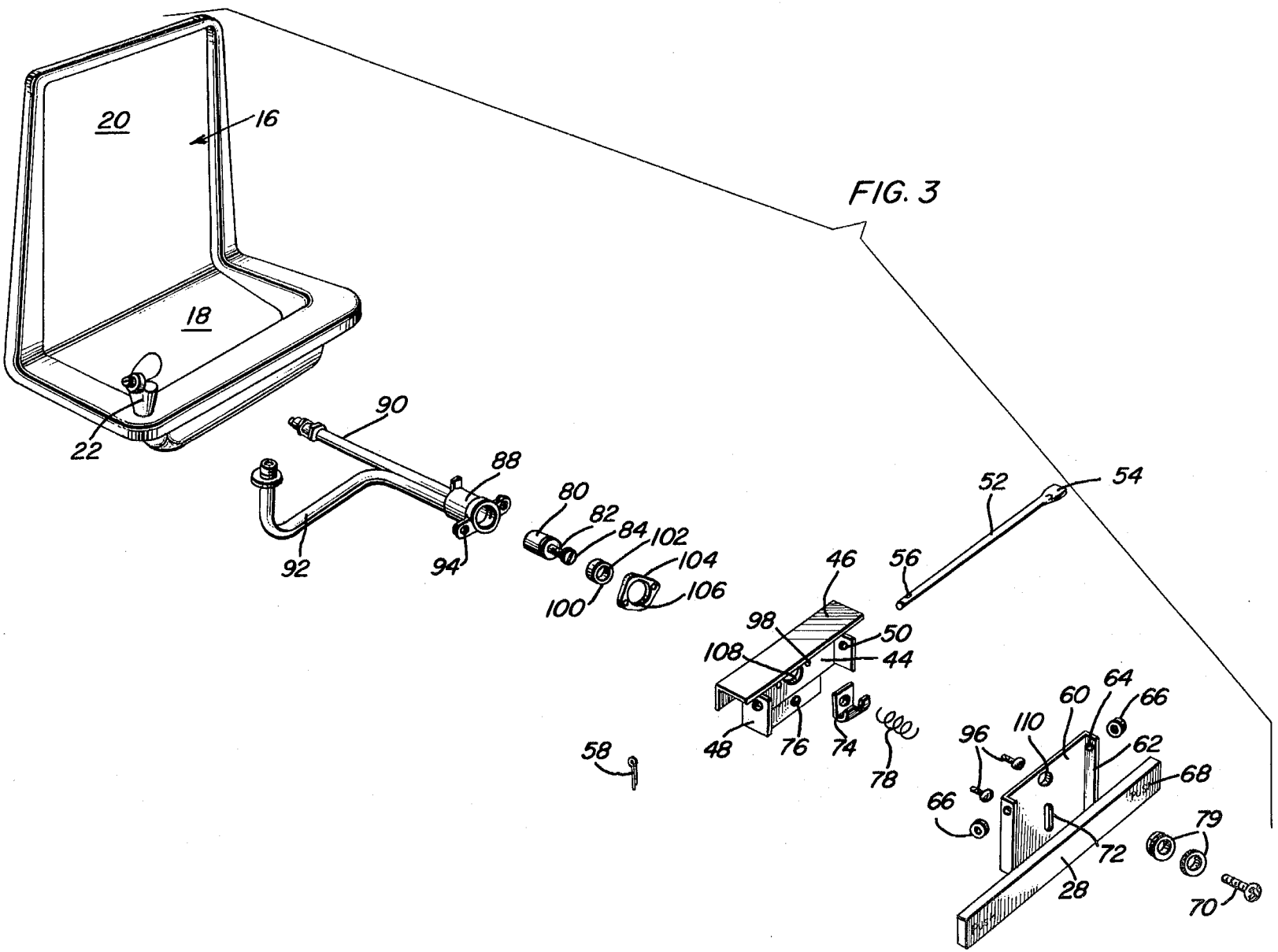
FIG. 3 is an exploded group perspective view of the components for controlling the flow of water.

FIGS. 2 and 3 illustrate the supporting and actuating mechanism, generally designated by numeral 40, for a control valve assembly generally designated by numeral 42 by which operation of the push bar 28 will control discharge of water from the bubbler 22 in the same manner as operation of the normal push button on the bubbler controls the flow of water in which the actual valve forming part of the valve assembly 42 is the same as a conventional bubbler valve associated with the conventional push button on a conventional bubbler.

The supporting and actuating mechanism includes a vertically disposed mounting plate 44 having a horizontal flange 46 at its upper edge for rigid mounting engagement with the undersurface of the basin 18 with this rigid connection being by spot welding or any other suitable means. The end edges of the vertical plate 44 include parallel wings 48 which are perpendicular to the plate 44 and of unitary construction therewith with the wings 48 actually being formed by providing an inward slit in each side edge of the plate 44 in spaced relation below the flange 46 and bending the wings 48 into perpendicular relation to the mounting plate 44. Each wing 48 includes an aperture 50 therein for receiving an elongated pivot pin 52 having a flattened end portion 54 at one end and an aperture 56 at the other for receiving a cotter pin 58. The pivot pin 52 pivotally supports a push bar mounting plate 60 between the wings 48 in which the plate 60 include lateral flanges 62 each with an aperture 64 adjacent the upper end for positioning on the pivot pin 52 with suitable washers 66 being provided between the wings 48 and the flanges 62, thereby pivotally supporting the push bar mounting plate 60 and the push bar 28 for pivotal movement about an axis defined by the pivot pin 52. The push bar 28 is elongated and rigidly affixed to the mounting plate 60 by rigid engagement with the flanges 62 such as by welding, or the like, and suitable indicia 68 may be provided on the push bar 28 to provide instructions to a user that the push bar 28 should be pushed in order to operate the drinking fountain.

As illustrated in FIG. 2, the fixed mounting plate 44 and the pivotal plate 60 are generally disposed in parallel relation when the push bar is in its normal position with this relationship being maintained by a screw threaded fastener 70 which extends through a slot-like hole 72 in the pivotal plate 60 and is screw threadedly engaged with a sheet metal nut 74 of conventional construction which is slid onto the lower end of the fixed mounting plate 44 with the screw receiving aperture 74 in the nut being disposed in alignment with an aperture 76 in the mounting plate 44 in a manner well-known in the art, so that the fastener 70 when extended through slot 72 and engaged with the sheet metal nut or other similar nut-like fastening device on the opposite side of the plate 44, the pivotal mounting plate 60 will be limited in its pivotal movement away from the fixed mounting plate 44 with the vertical slot 72 enabling the arcuate swinging movement of the pivotal plate 60. A compression coil return spring 78 is mounting on the fastener 70 and is disposed between the opposed surfaces of the pivotal mounting plate 60 and the fixed mounting plate 44 to bias the pivotal mounting plate and the push bar 28 mounted thereon to a returned position at any time inward force is not manually exerted on the push bar 28. A washer and grommet assembly 79 is provided on the fastener 70 with the washer being disposed against the head of the fastener and the rubber grommet including a peripheral groove receiving the edges of the slot 72 with the grommet being of rubber, neoprene, or the like, to provide quiet operation by reducing metal-to-metal contact between relative moving components. With this construction, the pivotal push bar mounting plate 60 will be spring biased back to its returned position whenever inward force is removed from the push bar 28.

The control valve assembly 42 includes a conventional control valve 80 having an adjustable actuator 82 in the form of a screw threaded member having a large, flat surface head 84 with a screw driver receiving kerf or groove 86 extending diametrically thereof so that the actuator 82 can be adjusted longitudinally in relation to the valve 80 for varying the effective length of the actuator. The valve 80 is received in a cylindrical mounting unit or body 88 associated with the water inlet 90 and water outlet 92 with the body 88 including laterally extending apertured ears or lugs 94 which enables support of the mounting unit or body 88 from the fixed mounting plate 44 by the use of screw threaded fasteners 96 extending through apertures 98 in the mounting plate 44. The valve 80 is retained in the mounting unit or body 88 by an annular, externally screw threaded collar or nut 100 having diametrically opposed sockets 102 therein which enable a spanner wrench to be used to screw the retaining nut into the mounting unit or body 88 for retaining the valve 80 therein. Disposed between the body 88 and the mounting plate 44, a correspondingly shaped adapter or bushing 104 is provided which includes apertures receiving the screws 96 and also an enlarged central aperture 106 receiving the adjustable actuator 82 which also extends through an enlarged hole or aperture 108 in the fixed mounting plate 44 so that it will abuttingly engage the inner surface of the pivotal push bar mounting plate 60 as illustrated in FIG. 2. Thus, when the push bar 28 is pushed inwardly, the actuator 82 will be pushed inwardly, generally in the same manner as a conventional push button on the bubbler will move an actuator for the bubbler valve inwardly, thus controlling flow of water from the bubbler 22. In order to adjust the position of the actuator 82 for each individual installation, the pivotal push plate 60 is provided with a small aperture 110 aligned with the head 84 of the actuator 82 but of smaller diameter than the head 84 so that the head 84 will not pass through the aperture 110. However, the aperture 110 is sufficiently large to receive a screw driver blade which can engage the kerf or groove 86 thereby enabling adjustment of the actuator 82 for varying the flow characteristics from the bubbler 22 by merely removing the apron 24 which is held in place by sheet metal screws along the bottom thereof in a conventional and well-known manner. If it becomes necessary to adjust the valve actuator 82 during normal use, it is only necessary to remove the apron 24 and insert a screw driver through the small hole 110 into the groove 86. If it becomes necessary to replace the valve 80, the pivot mounting plate 60 may be easily removed after which the screws 96 may be removed and the body 88 moved to a position to enable the annular nut 100 to be removed with the movement of the body 88 being permitted by the water inlet line and water outlet line 90 and 92 being of flexible construction.

The drinking fountain 10 includes a conventional refrigerating device to provide chilled water to the inlet line 90 in a conventional manner. As illustrated in FIG. 1, the push bar enables a handicapped occupant or other to effectively control the flow of water from the bubbler. Even if the occupant of the wheel chair is severely handicapped, the position of the push bar adjacent the level of the arms of the wheel chair enables the hands of the occupant which are usually positioned on or adjacent the arms of the wheel chair to quite easily operate the push bar. For example, in FIG. 1 the occupant of the wheel chair can use one hand to operate the push bar while the other hand can be used to stabilize or manipulate the wheel chair into desired position. Also, the wheel chair can be maneuvered into a position whereby the occupant can activate the push bar by exerting pressure thereon with the abdomen or lower chest region thus leaving both hands free to stabilize the wheel chair. Inward pressure on the push bar at any point along the length thereof will serve to control the flow of water from the bubbler due to the laterally spaced points of pivotal support of the pivotal push bar mounting plate. All of the components are easily installed and removed and are relatively inexpensive to manufacture.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a drinking fountain of the wall hung type comprising a cabinet adapted to be mounted in hanging relation upon a building wall, said cabinet including a front wall parallel to the building wall, feed water inlet means and spill water outlet means for the cabinet, a drinking spout mounted on the cabinet, and a control valve interposed between the water inlet means and the drinking spout, the improvement comprising control valve actuating means comprising a horizontally elongated push bar movable inwardly and outwardly with respect to the front wall of the cabinet and means linked mechanically between said push bar and said control valve for supporting the push bar in parallel relation to the front wall of the cabinet and controlling the position of the control valve with the push bar at a height adjacent the arms of a wheelchair for manual activation by a wheelchair occupant while the occupant is simultaneously engaged in drinking water ejected in an upward trajectory from said drinking spout, said control valve comprising a housing and horizontal actuator rod allowing water flow only upon inward movement of the rod with respect to the housing, and said means linked mechanically between the push bar and control valve comprising a channel-shaped pivot plate with a flat, enlarged, generally vertically disposed portion which is approximately perpendicular to said actuator rod and engageable with the end of the actuator rod, said pivot plate having vertically disposed generally parallel wings extending from the side edges therof, an elongated generally horizontal pivot pin passing through the wings on the pivot plate near their upper extremity, said push bar being secured across the lower extremity of the wings, the pivot plate being engaged with the actuator rod below said pivot pin, said push bar being longer than the distance between the wings and oriented in an elongated slot in the front wall of the cabinet, a control valve bracket mounted in fixed relationship with said cabinet and comprising a fixed vertical plate substantially perpendicular to said actuator rod, means fixedly securing the control valve to the fixed plate, said fixed plate including lateral, parallel wings on the vertical side edges thereof receiving said pivot pin thereby pivotally supporting the pivot plate for pivotal movement about a horizontal axis generally parallel to the front wall of the cabinet, said fixed plate including an aperture therein receiving said actuator rod, bias means comprising a return spring and bolt in generally perpendicular relationship to said fixed plate and said pivot plate and disposed below the pivot pin and below and generally parallel to the actuating rod but above the push bar, and bolt passing slidably through a vertically elongated aperture in said pivot plate and being fastened to said fixed plate, said return spring being in the form of a light force coil spring axially encircling said bolt between the plates and acting outwardly along said bolt against the pivot plate and the fixed plate to oppose inward movement of the push bar, said pivot plate including an aperture smaller than the end of the actuator rod to enable access to the end of the actuator rod for rotational adjustment thereof, said wings on the fixed plate and pivot plate being disposed adjacent to each other and at a substantial distance from the actuator rod, said elongated pivot pin engaging the wings at widely spaced support points to stabilize the pivot plate and maintain the push bar straight and parallel to the front wall of the cabinet even when inward force is applied to an end portion thereof.

2. A control for a drinking fountain having a generally horizontally disposed basin with a waste water drain and a bubbler for discharging water in a vertical arcuate path, said control comprising a horizontally elongated push bar, means supporting said push bar enabling inward movement by a small force applied thereto at any point along the length thereof and in a position below the level of the basin and bubbler at a height generally equal to the heights of the arms of a wheelchair whereby the push bar is readily accessible to a handicapped occupant of a wheelchair when the wheelchair is rolled to a position adjacent the drinking fountain, and means associated with the push bar and bubbler to control flow of water from the bubbler, said basin being disposed atop a wall mounted cabinet structure terminating above the floor surface a distance to enable a wheelchair to move partially under the cabinet with the arms of the wheelchair adjacent the lower edge thereof, said push bar being movably disposed in a slot-like opening adjacent the bottom of the cabinet in a position adjacent the hands of a handicapped occupant of a wheelchair whose arms are positioned on the arms of a wheelchair to enable the wheelchair occupant to control water flow, said control including a valve controlling flow of water to the bubbler, said valve including a generally horizontally disposed actuator rod oriented generally perpendicular to the push bar and inwardly thereof and above the plane of the push bar, said means supporting the push bar including a pivot plate, means supporting the pivot plate for swinging movement about a horizontal axis parallel to the push bar, generally perpendicular to the actuator rod and located above the actuator rod, said pivot plate including means engaging the actuator rod for operating the valve upon inward movement of the push bar, said means supporting said push bar including light force spring means connected with the pivot plate to return the pivot plate and push bar to a position to stop flow of water to the bubbler, said pivot plate being generally vertically disposed and horizontally elongated for supporting engagement with the push bar over a substantial portion of the length thereof with the pivot plate stabilizing the push bar to retain it in parallel relation to its "at rest" position regardless of where forces are exerted on the push bar along its length.

* * * * *